United States Patent [19]

Tan

[11] Patent Number: 4,873,527

[45] Date of Patent: Oct. 10, 1989

[54] ANTENNA SYSTEM FOR A WRIST CARRIED PAGING RECEIVER

[75] Inventor: William Tan, Lantana, Fla.

[73] Assignee: Motorola, Inc., Schaumburg, Ill.

[21] Appl. No.: 141,455

[22] Filed: Jan. 7, 1988

[51] Int. Cl.[4] ..... H01Q 7/08

[52] U.S. Cl. ..... 343/718; 343/788

[58] Field of Search ..... 343/718, 702, 742, 728, 343/744, 867, 748, 866, 788, 787, 729; 455/274, 344, 347, 351, 100

[56] References Cited

U.S. PATENT DOCUMENTS

| | | | |
|---|---|---|---|
| 2,255,897 | 9/1941 | Rebori et al. | 343/718 |
| 3,683,389 | 8/1972 | Hollis | 343/744 |
| 4,155,091 | 5/1979 | Vorie | 343/744 |

FOREIGN PATENT DOCUMENTS

| | | | |
|---|---|---|---|
| 676743 | 12/1963 | Canada | 343/788 |
| 100639 | 2/1984 | European Pat. Off. | 343/718 |
| 655205 | 3/1986 | Switzerland | 343/718 |

*Primary Examiner*—William L. Sikes

*Assistant Examiner*—Michael C. Wimer

*Attorney, Agent, or Firm*—Michael J. DeLuca; Vincent B. Ingrassia

[57] ABSTRACT

The antenna system of the present invention includes a single loop antenna connected in series with a ferrite core loop antenna. The single loop antenna is enclosed in a nonconductive housing, such as a band, which surrounds the wrist. The single loop antenna has a first end grounded and is connected in series with a first variable capacitive element for adjusting the resonant frequency of the single loop antenna. The ferrite core loop antenna is connected to a second variable capacitive element for adjusting the resonant frequency of the ferrite core loop antenna. One end of the ferrite core loop antenna is applied as an input to a communication receiver such as a paging receiver. The outstanding feature of the antenna system is that the axis of the single loop antenna is perpendicular to and noncoplanar with the ferrite core loop axis for enhancing the sensitivity and minimizing body effects caused by hand movements.

8 Claims, 8 Drawing Sheets

Fc=157.75MHZ

FERRITE ANTENNA
Fc=157.75MHZ

Fc=157.75MHZ
LOOP ANTENNA

ANTENNA SYSTEM FOR A WRIST CARRIED PAGING RECEIVER

BACKGROUND OF THE INVENTION

1. Field of the Invention

This invention relates in general to series resonating circuits and more particularly to an antenna arrangement formed by a ferrite loop antenna in series with a single loop antenna.

2. Background Discussion

In portable radio and especially in paging equipment and related applications, size is an extremely important factor. In the past, many portable paging devices employed an antenna for receiving purposes which tended to significantly increase the overall dimensions of the device of which it is a part which may be a prohibiting factor especially when compactness is a primary consideration. At the same time, no degradation in performance can be tolerated to any large extent. This is particularly so with respect to antenna apparatus. High gain response is most desirable and, indeed, critical for the full range capabilities of the paging receivers to be realized. However, because of size limitations, the associated antenna arrangement cannot take the usual form of high gain antenna configurations conventionally encountered in paging devices.

In the past, a typical paging receiver has been normally worn on the side of the body when in use, usually attached to the belt or in a pocket. However, there has been greater importance placed on decreasing the size of the receiver in an aesthetic pleasing package. Unlike past paging receivers, a wrist carried paging receiver is strapped around the wrist of the paging user, similar to a watch. Thus, a wrist carried paging receiver is used in many different body positions. It may be held in front of the face, on the side of the body, outstretched from the human body, or placed on a conducting or non-conducting surface. Thus, for a wrist carried paging receiver, the overall sensitivity must be designed to maximize reception in all possible body positions.

Furthermore, a paging receiver designed to be carried by the wrist, is even more sensitive to size and antenna configuration. Wrist carried radio sets in the past as shown in U.S. Pat. No. 3,032,651 to Gisiger-Stahi et al, have incorporated supertime loop antennas or simple loop type antennas which are typically responsive to the magnetic field component of the transmitted RF signal. This type of antenna system provided marginal performance but was desirable because the loop antenna could be concealed within the wrist band housing and responded well when the receiver was in close proximity to a human body. However, the overall sensitivity of the antenna receiver combination was somewhat degraded when the receiver was not in close proximity to a human body.

Another way to achieve an effective compromise between gain and size factor was to employ a ferrite rod antenna for a paging receiver This is a magnetic antenna structure as contrasted to the usual electric antenna structure. As is known, magnetic antenna devices of this sort are usually in the form of a rod or cylinder, a ferrite material on which a spiral conductor is wound. The spiral conductor forms a completely closed loop, and the ferrite core serves to concentrate the magnetic lines of flux and thereby induce an appropriate voltage signal in the enclosed loop configuration.

For a wrist carried paging receiver, the conventional ferrite antenna structure nevertheless has a number of disadvantages, particularly when operating at relatively high frequencies is required, say in the UHF frequency range, problems in effectively resonating the antenna apparatus are experienced. Too many turns of conductor on the ferrite core results in excessive inductance which in turn makes the necessary capacitance for resonance impractical. That is, the value of the capacitance becomes inordinately small. Reducing the number of turns to obtain a more practical value for the resonating capacitor, however, reduces the level of induced voltage and thus is counterproductive with respect to gain.

Moreover, at the higher frequencies, hand capacity, while a relatively low value, nevertheless presents an alternate or parallel path for sufficiently low impedance to significantly increase the loss factor with respect to the antenna device as a whole. The term "hand capacity" in this regard generally denotes one capacitative effect produced by the close proximity of the antenna device to any part of the human body. Furthermore, the ferrite loop antenna produces a highly directional polarization field response which exhibits poor sensitivity when the loop axis is quadrature to the direction of the transmitting signal.

Thus, it would be highly desirable to provide an antenna system which satisfies the aesthetic size problems associated with a wrist carried paging receiver and avoids the undesirable effect of changing sensitivity when the orientation of the wrist carried paging receiver is changed.

SUMMARY OF THE INVENTION

The present invention has been developed for the purposes of eliminating the problems of prior art wrist carried paging receiver antenna systems. Accordingly, the invention has as its object an antenna system which provides an aesthetically pleasing appearance associated with a wrist carried paging receiver and which exhibits a substantially small null radiation response for various conditions of hand movement.

Another object of the present invention is to provide a subminiature antenna system which is substantially insensitive to changing the orientation of the wrist carried paging receiver device to which the antenna is attached.

In general, the antenna system of the present invention includes a single loop antenna connected in series with a ferrite core loop antenna. The single loop antenna is enclosed in a nonconductive housing, such as a band, which surrounds one wrist. The single loop antenna has a first end grounded and is connected in series with a first variable capacitive element for adjusting the resonant frequency of the single loop antenna. The ferrite core loop antenna is connected to a second variable capacitive element for adjusting the resonant frequency of the ferrite core loop antenna. One end of the ferrite core loop antenna is applied as an input to a communication receiver such as a paging receiver. The axis of the single loop antenna is perpendicular to and non-coplanar with the ferrite core loop axis for enhancing the sensitivity and minimizing body effects caused by hand movements.

DETAILED DESCRIPTION OF A PREFERRED EMBODIMENT

Figure 1:
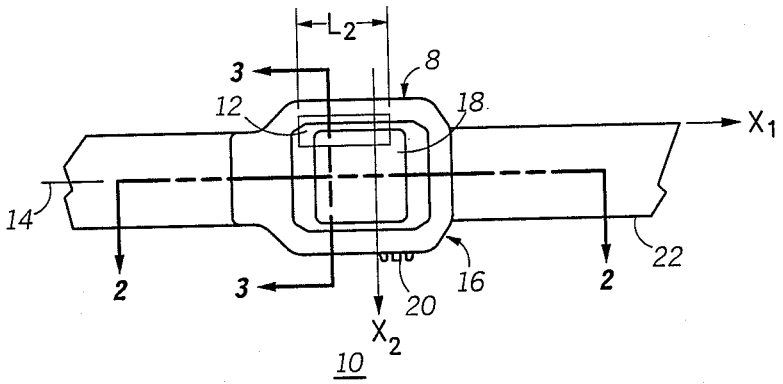
FIG. 1 is a top view of a wrist carried paging receiver employing the antenna system of the present invention.
Figure 2:
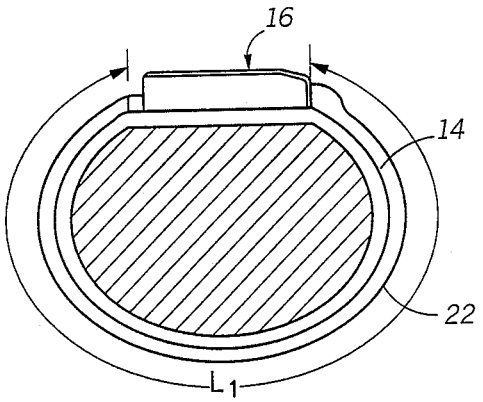
FIG. 2 is a sectional view taken along line 2—2 of FIG. 1 illustrating the single loop antenna.
Figure 3:
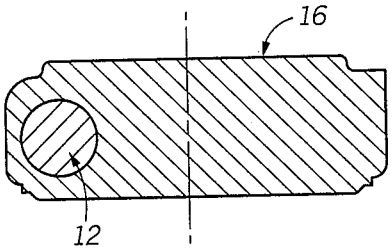
FIG. 3 is a sectional view taken along 3—3 of FIG. 1 showing a cross sectional view of the ferrite core loop antenna.

Referring now to the drawings, wherein like reference numerals designate identical or corresponding parts throughout the several views, and more particularly to FIGS. 1, 2 and 3 thereof, a wrist carried paging receiver using an antenna system according to the present invention is illustrated. The antenna system 8 comprises a ferrite core loop antenna 12 in series with a single loop antenna 14. The loop axis designated as X1 for the ferrite core loop antenna 12 is perpendicular to and non-coplanar with the loop axis designated as X2 for the single loop antenna 14. The paging receiver designated generally as 16 includes a display 18 and includes input switches 20 for operating the paging receiver in a manner well known to those of ordinary skill in the art. The antenna system 8 is designed to have an operational bandwidth from 138 to 174 MHz.

As known in the art, the antenna structure 12, as depicted in FIG. 1, is commonly referred to as a ferrite core loop antenna. As such, it is a magnetic antenna arrangement as distinguished from the more frequently encountered electrical antennas. The ferrite core loop antenna structure 12 includes a closed loop formed by a plurality of turns of wires or conductors about a ferrite magnetic core in which magnetic lines of flux are effectively concentrated, dependent upon the permeability factor. In any event, the length of the wire conductor itself is not critical since resonance at the desired frequency of operation may be achieved by a series or parallel capacitance interconnected with a spiral conductor serving as the inductance in the overall reactance circuit. The electrical properties of the ferrite loop antenna 12 are discussed in detail with reference to FIGS. 4–7.

In this regard, it will be appreciated to those skilled in the art that it is customary and desirable to incorporate as many turns of wire conductors as possible, within design limits, on the magnetic core so as to optimize the induce voltage and thereby overall antenna gain. A relatively high number of turns are obtainable for such antenna structures operating at the lower frequency, say, for example, in the AM and FM radio broadcast range.

As illustrated in FIG. 1, the ferrite loop antenna is situated off center from the center of paging receiver 16 because of mechanical packaging. The off center position of the ferrite core loop antenna permits an aesthetically pleasing thin profile for the wrist carried paging receiver.

As known in the art, the antenna structure 14, as depicted in FIG. 1, is commonly referred to as a single loop antenna. Loop antennas are characterized in that they are highly directional and thus can be very highly sensitive. In the structure shown, the single loop antenna is enclosed in the nonconducting band 22 of the wrist carried pager 10 illustrated in FIG. 1.

Referring now to FIG. 2, there is a sectional view taken along line 2—2 of the wrist carried pager 10 as illustrated in FIG. 1. The single loop antenna 14 is enclosed in the band 22 of paging receiver 16. The single loop antenna 14 exhibits a directional polarization providing increased sensitivity in hand orientation in reference to the body of the paging receiver user. The single loop antenna 14 is comprised of approximately 3.5 mil thick of beryllium copper strip wire in order to provide element rigidity and conductivity. It should also be noted that any metallic wire demonstrating sufficient flexibility and conductivity may be used.

Referring now to FIG. 3, there is shown a sectional view of FIG. 1 taken along section line 3—3. As is evident, the ferrite core loop antenna 12 is offset from the plane of magnetic loop antenna 14 such that the loop axis Xl of ferrite loop antenna is also non-coplanar with the plane of the loop of loop antenna 14.

Figure 6:
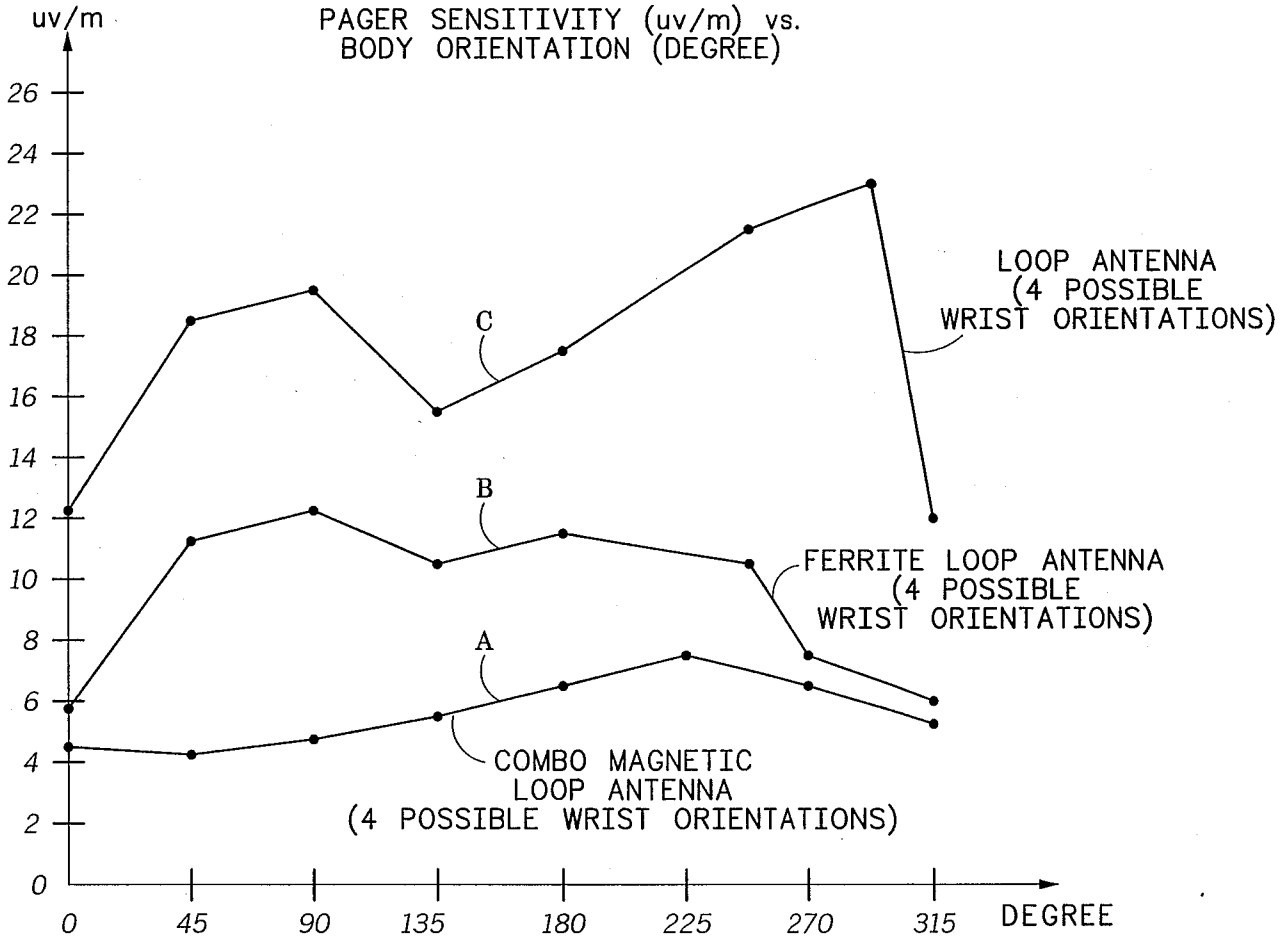
FIG. 6 is a graph of average sensitivity versus body positions as defined in FIG. 5.

It should be noted that the ferrite core loop antenna described above is designed to operate inside an approximately 0.12 inch thick dielectric housing having a dielectric constant of approximately 4. However, with modifications to the dimensions, the antenna will operate in a multiplicity of environments including free space. Further, the single loop antenna 14 is designed to operate inside an approximately 0.09 inch thick band of the watch having a dielectric constant of approximately 3. However, with proper modifications to the dimensions, the antenna will operate in a multiplicity of environments including free space. Moreover, the antenna system 8 is found to be highly efficient within this range as illustrated in FIGS. 6 and 7.

The distance as well as other critical distances of the antenna structure are designated as L1 through L2 in FIGS. 1, 2 and 3. For an antenna operable in the 138–174 MHz frequency band, the dimensions of L1 and L2 and the value of the resonant capacitors 30 and 36 are tabulated in Table 1. These dimensions are, of course, presented only by way of example and are not to be limiting. Those skilled in the art will recognize that these dimensions may be empirically or otherwise adjusted to obtain modified operational parameters.

TABLE 1

| Parameter | Value |
|---|---|
| L1 | Approximately 14 to 20 cm |
| L2 | Approximately 1.2 to 1.8 cm with approximately four (4) turns |
| $C_{30}$ | Approximately 2–10 pF |
| $C_{36}$ | Approximately 2–10 pF |

Figure 4:
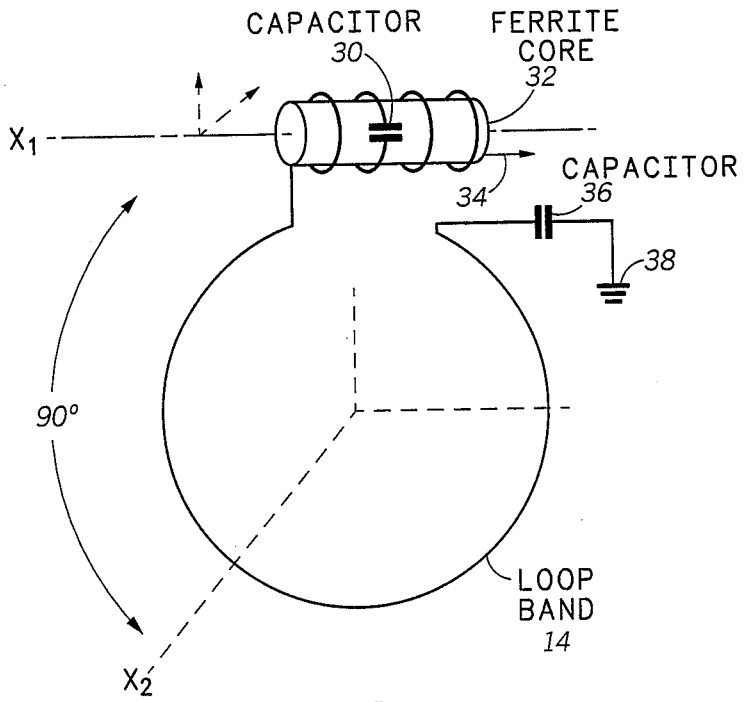
FIG. 4 is an electrical schematic diagram of the antenna system of the present invention.

Turning now to FIG. 4, there is shown an electrical schematic diagram of the antenna system 8. The antenna system 8 is comprised of a ferrite core loop antenna 12 in series with a single loop antenna 14. One end 34 of the antenna system 8 is applied as an input to the receiving section of the paging receiver. The other end 38 is grounded. To adjust the resonant frequency of the ferrite core loop antenna, a variable capacitive element 30 is placed in series with a plurality of loop wires enclosed over a ferrite core 32. The capacitive element 30 allows the ferrite loop antenna to be trimmed to a resonant frequency. The single loop antenna 14 is grounded at one end 38 and includes a capacitive element 36 which permits the single loop antenna to be trimmed to a resonant frequency. The single loop antenna 14 is enclosed in the band 22 the wrist carried pager 10. The single loop antenna 14 is electrically coupled in series to the ferrite core loop antenna 14 having one end 34 which electrically communicates with the receiving section of the wrist carried pager 10 to receive paging type signals. As illustrated, the loop axis X2 is shifted 90 degrees from the loop axis X1 of the ferrite core loop antenna. The non-coplanar functionality of the antenna system arrangement produces a superior average induced voltage or average paging sensitivity than either the ferrite loop antenna 12 or the single loop antenna 14 alone.

In operation, when the antenna of the invention is excited, a first field is created by the ferrite core loop antenna whereas a second field is created by the single loop antenna. The first and second fields each exhibit the same polarization, but these fields axes are quadrature. Thus, since two fields are generated, if the subject antenna comes in close proximity to the human body, for example, in the four wrist orientation 40–46, advantageously only one of two fields is substantially diminished in terms of amplitude of the radiated signal. The other field remains substantially undiminished in amplitude despite close proximity of the antenna to the body. Stated alternatively, by vectorially switching the amplitude of these two fields, the antenna of the present invention substantially reduces the worst null radiation pattern. Moreover, the subject antenna can respond to a field that neither the ferrite core loop antenna nor the single loop antenna can respond to.

Figure 5:
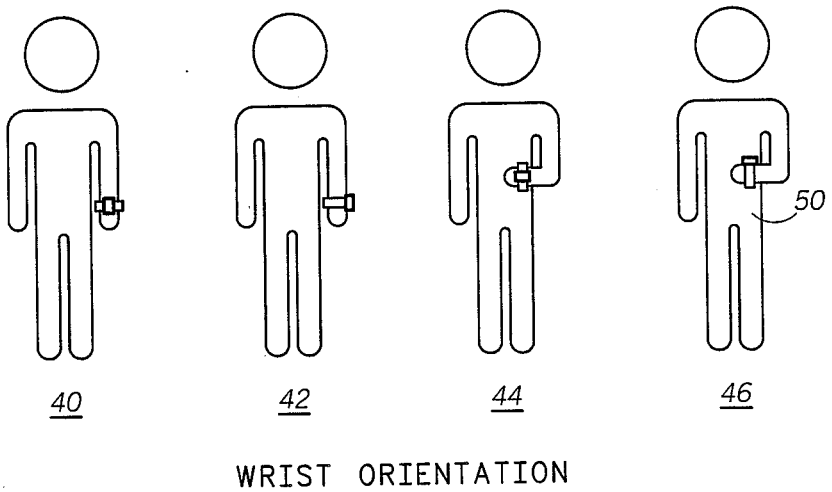
FIG. 5 is a graphical representation of the position of the body used to obtain data points for response characteristics which are useful in understanding certain aspects of the present invention.

Referring to FIG. 5, there is shown four wrist orientations 40–46 used to collect the sensitivity data as shown in FIGS. 6 and 7. In the first wrist orientation 40, the arm is dropped by the side of the body 50 with the pager display pointing forward of the body 50. In the second wrist orientation 42, the arm is by the side of the body 50 with the paging display pointed away from the body 50. In the third wrist orientation 44, the arm is placed in front of the body 50 close to the chest with the pager display pointed away from the body 50. In the fourth wrist orientation 46, the arm is placed in front of the body 50 close to the chest with the pager display pointing up.

In collecting the data, the four wrist orientations 40–46 are averaged into one body position. The body 50 is then rotated 45 degrees and the four wrist orientations 40–46 are then averaged into the second body position FIGS. 6 and 7 show eight body positions from zero to 360 degrees, each body position being comprised of the average of the four wrist orientations 40–46 as shown in FIG. 5.

FIG. 6 illustrates the average sensitivity verses body orientation for the antenna system 8 comprised of the ferrite core loop antenna 12 and the single loop antenna 14. Graph A represents the antenna system 8 Additionally, for comparison purposes, graph B illustrates the sensitivity versus body orientation for the ferrite loop antenna 12 only. Finally, graph C illustrates the sensitivity versus body orientation for the single loop antenna 14. From the sensitivity pattern of FIG. 6, it is seen that the antenna system 8 exhibits substantially uniform sensitivity over the entire range of body orientation. Stated alternatively, the antenna of the present invention as shown by the data exhibits superior performance to the single loop antenna and the ferrite loop antenna by approximately 4.6 dB and 10 dB of the 8-position body average sensitivity, respectively. For example, when the body is at the 180 degree position, the average of the four wrist orientations produces a value of 11.46 uV/M for the ferrite loop antenna, 17.7 uV/M for the magnetic loop antenna, and 6.74 uV/M for the antenna system comprising the ferrite loop antenna and the magnetic loop antenna. As is evident, the combination of the ferrite loop antenna and magnetic loop antenna is far superior than the individual performance of either the ferrite loop antenna or the loop band antenna.

Figure 7A:
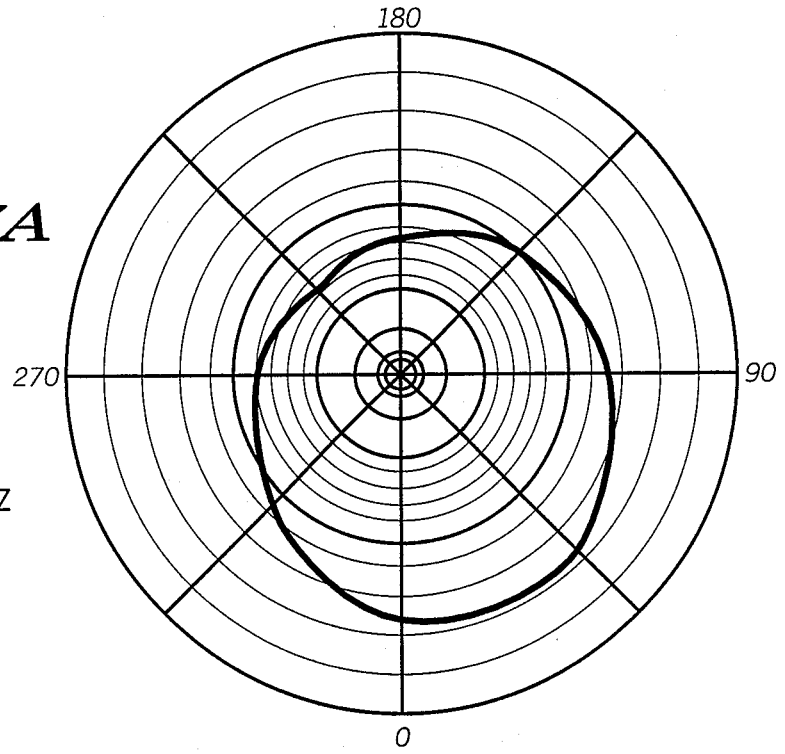
FIGS. 7A–C illustrate showing the average field sensitivity pattern of the antenna system of the present invention for different orientations of the antenna as compared with a single magnetic loop antenna and a ferrite core loop antenna.
Figure 7B:
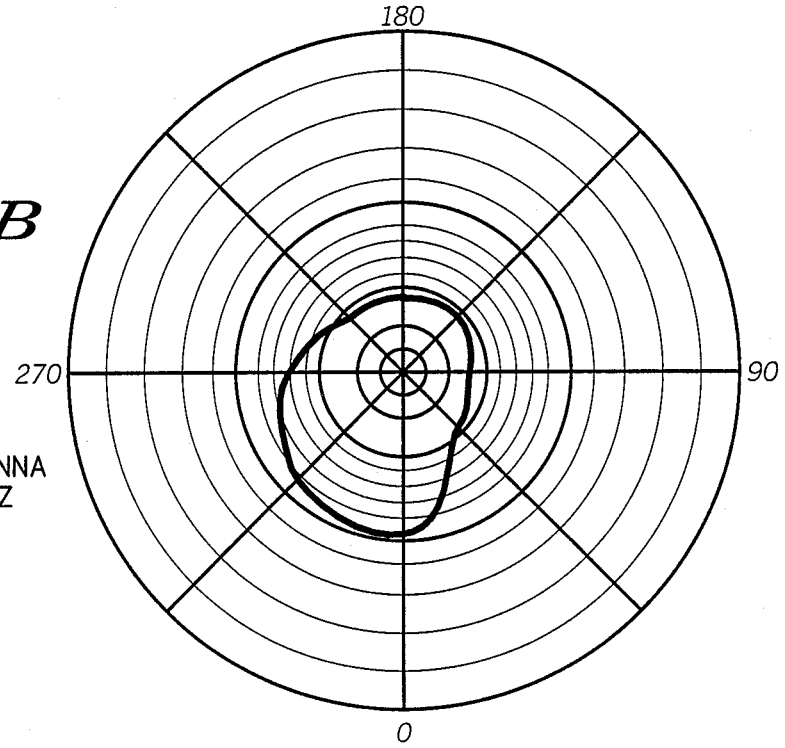
Figure 7C:
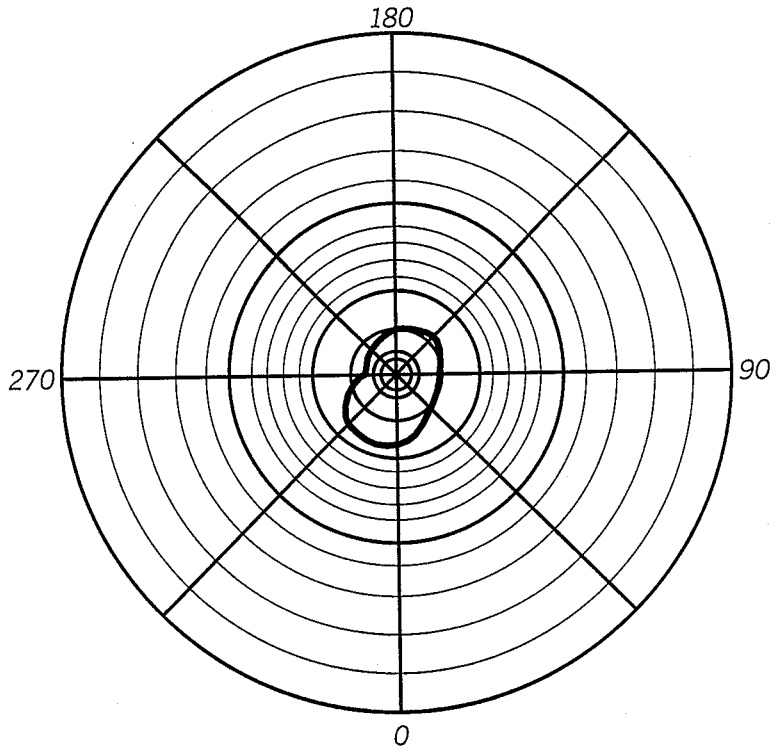

Referring now to FIG. 7A–C, there is shown a comparison of the average field sensitivity pattern for the antenna system, the ferrite loop antenna, and the single loop antenna. FIG. 7A represents the antenna system comprise, the single loop antenna and the ferrite loop antenna. FIG. 7B represents only the ferrite loop antenna, while FIG. 7C represents the magnetic loop antenna. In this figure, the performance of the antenna of the present invention is seen to be far superior than either one of the magnetic loop antennas or the ferrite loop antenna. Also it is shown that: the non-coplanar combination of the ferrite loop antenna and the magnetic loop antenna cause the present invention to have a more uniform sensitivity over the range of body orientation.

Thus, it is apparent that in accordance with the present invention, an antenna system fully satisfies the objective aims and advantages set forth above. While the invention has been described in conjunction with a specific embodiment, it is evident that many alternatives, modifications, and variations will become apparent to those skilled in the art in the light. of the foregoing description. Accordingly, it is intended that the present invention embraces all such alternatives, modifications, and variations as fall within the spirit and broad scope of the appended claims.

What is claimed is:

1. An antenna system for a wrist carried paging receiver comprising:

a single magnetic loop antenna having first and second ends, said loop antenna enclosed in a non-conductive housing surrounding the wrist, said single magnetic loop antenna having the first end grounded;

a ferrite core loop antenna connected in series to the second end of said magnetic loop antenna, said ferrite core loop antenna having an output applied as an input to a receiving means of the paging receiving selective call signals; and further wherein, an axis of the single magnetic loop antenna is perpendicular to and non-coplanar with the ferrite core loop axis.

2. The antenna system of claim 1, wherein said single magnetic loop antenna is connected in series with a first capacitive element for adjusting the resonant frequency of said single magnetic loop antenna.

3. The antenna system of claim 1, wherein said ferrite core loop antenna is connected in series to a second capacitive element for adjusting the resonant frequency of the ferrite core loop antenna.

4. The antenna system of claim 1, wherein the circumference of the loop of the single magnetic loop antenna ranges from approximately 14 cm to approximately 20 cm.

5. The antenna system of claim 1, wherein the length of the ferrite core loop antenna along the ferrite core loop antenna axis ranges from approximately 1.2 cm to approximately 1.8 cm.

6. The antenna system of claim 1, wherein said ferrite core loop antenna and said receiving means are enclosed in a housing coupled to said non-conductive housing enclosing said single magnetic loop antenna.

7. The antenna system of claim 6, wherein said housing enclosing said ferrite core loop antenna and said receiving means is non-conductive.

8. The antenna system according to claim 4, wherein the circumference of the loop of said single magnetic loop antenna is adjusted to fit the wrist.

* * * * *

UNITED STATES PATENT AND TRADEMARK OFFICE

CERTIFICATE OF CORRECTION

PATENT NO. : 4,873,527

DATED : October 10, 1989

INVENTOR(S) : William Tan

It is certified that error appears in the above-identified patent and that said Letters Patent is hereby corrected as shown below:

Claim 1, column 6, line 54/55 after paging insert --receiver for--.

Signed and Sealed this

Eighteenth Day of September, 1990

*Attest:*

HARRY F. MANBECK, JR.

*Attesting Officer*

*Commissioner of Patents and Trademarks*